US006882286B1

(12) United States Patent
Yamamoto

(10) Patent No.: US 6,882,286 B1
(45) Date of Patent: Apr. 19, 2005

(54) REMOTE CONTROLLER AND ELECTRICAL APPARATUS CONTROLLED BY THE SAME

(75) Inventor: Kazuhiko Yamamoto, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 09/553,051

(22) Filed: Apr. 20, 2000

(30) Foreign Application Priority Data

Apr. 20, 1999 (JP) ..... 11-002636
Sep. 22, 1999 (JP) ..... 11-268395

(51) Int. Cl.[7] ..... G08C 19/00
(52) U.S. Cl. ..... 340/825.69; 340/825.57; 340/825.72
(58) Field of Search ..... 340/825.69, 825.72, 340/825.57, 693.3, 5.22, 5.23, 5.24, 5.25, 5.26, 5.27, 825.64

(56) References Cited

U.S. PATENT DOCUMENTS 5,115,236 A * 5/1992 Kohler ..... 340/825.69
5,153,580 A * 10/1992 Pollack ..... 340/825.69
5,170,108 A * 12/1992 Peterson et al. ..... 318/469
5,650,831 A * 7/1997 Farwell ..... 340/825.69
6,049,885 A 4/2000 Gibson et al. ..... 713/324
6,100,814 A * 8/2000 Doyle ..... 340/825.69
6,204,796 B1 * 3/2001 Chan et al. ..... 340/825.69
6,236,850 B1 * 5/2001 Desai ..... 340/10.1

FOREIGN PATENT DOCUMENTS

| | | |
|---|---|---|
| JP | 3-159497 | 7/1991 |
| JP | 4-245894 | 2/1992 |
| JP | 4-88759 | 3/1992 |
| JP | 5-40559 | 6/1993 |
| JP | 7-255091 | 10/1995 |

* cited by examiner

*Primary Examiner*—Michael Horabik
*Assistant Examiner*—Clara Yang
(74) *Attorney, Agent, or Firm*—Crowell & Moring LLP

(57) ABSTRACT

A power-on code $C_o$ is added to a position preceding a code C including a header H and a subsequent data signal D. In response to reception of the code $C_o$, the operation mode is switched from the stop mode to the fast mode before the header H is received. Even when the operation mode in a standby mode is set to the stop mode, therefore, the header H can be correctly decoded.

6 Claims, 5 Drawing Sheets

C

H
D

FAST MODE
STOP MODE
T1

10 ~ 20mA
SEVERAL μA

REMOTE CONTROLLER AND ELECTRICAL APPARATUS CONTROLLED BY THE SAME

BACKGROUND OF THE INVENTION

The present invention relates to a remote controller, and an electrical apparatus such as a television receiver which is controlled by the remote controller.

FIG. 3 is a block diagram schematically showing the configuration of a television receiver. Referring to the figure, 1 denotes a main unit of the television receiver. The main unit 1 includes a tuner section 2, a video detecting and amplifying section 3, an audio circuit section 4, a signal receiving section 5, a key input section 6, and a control section 7 which is configured by a microcomputer. The reference numeral 8 denotes a tuner terminal to which an antenna 9 is connected, 10 denotes an external input terminal to which a VTR (Video Tape Recorder) 11 serving as an external video apparatus is connected, and 12 denotes a switch for switching the connection of the video detecting and amplifying section 3 to either of the tuner section 2 and the VTR 11. The reference numeral 13 denotes a remote controller which transmits a remote control signal to the main unit 1. The receiver main unit 1 and the remote controller 13 constitute a remote control system of the present invention.

In the configuration of FIG. 3, in the case where the switch 12 is in the position indicated by the solid line, a received signal which is received by the antenna 9 is input into the tuner section 2, and a signal of a frequency which is tuned by the tuner section 2 is sent to the video detecting and amplifying section 3 via the switch 12. The video detecting and amplifying section 3 detects a video signal from the received signal, amplifies the video signal, and then outputs the amplified video signal to a CRT (Cathode Ray Tube). An audio signal which is separated from the video signal in the video detecting and amplifying section 3 is subjected to audio processing in the audio circuit section 4, and then sent to a speaker. In the case where the switch 12 is in the position indicated by the broken line, an output signal of the VTR 11 is sent to the video detecting and amplifying section 3 via the switch 12, and then subjected to the same processing as described above.

The remote controller 13 includes various keys such as a power source key, a tuner key, and a volume key. When one of the keys is operated, the transmitter produces a remote control signal corresponding to the key, and then transmits the signal toward the receiver main unit 1. The remote control signal is received by the signal receiving section 5, and then sent to the control section 7. By contrast, also the key input section 6 includes various keys such as a power source key, a tuner key, and a volume key, and sends a signal corresponding to one of the keys which is manually operated, to the control section 7. The control section 7 is configured by a microcomputer (hereinafter, the control section 7 is referred to as the microcomputer 7), and, on the basis of the remote control signal received by the signal receiving section 5 and the signal from the key input section 6, performs various controls such as power on/off, tuning, and volume adjustment on the sections of the receiver main unit 1. A television receiver which uses such a remote controller is disclosed in, for example, Japanese Patent Publication No. 4-245894A.

FIG. 5A is a waveform chart showing the remote control signal (usually, infrared light) which is transmitted from the remote controller 13 of the related art. As shown in the figure, the remote control signal is configured by a code C which consists of a combination of plural pulses and includes the leading header H and a subsequent data signal D. The header H is a code indicating that the signal is a remote control signal, and, in order to be clearly distinguished from noises, the pulse width is set to be long. The data signal D consists of a pulse train indicating either of codes which respectively correspond to the contents of the above mentioned various controls.

Such a television receiver has a mode which is called a standby mode, and in which, even when the power source switch of the main unit 1 is off, a small current is kept to be supplied to the main unit 1 so that, upon input of a remote control signal instructing the power on, the receiver can immediately start to operate. In the standby mode, the microcomputer 7 always consumes a current of about 10–20 mA. If the current level is suppressed to several $\mu$A, it is possible to attain a large power saving effect. In order to realize this, the microcomputer 7 in a standby mode is requested to be set to a stop mode.

The stop mode means a state where a microcomputer stops the oscillating operation so as not generate a clock signal. A microcomputer has a fast mode as opposed to the stop mode. The fast mode means a state where a microcomputer performs the oscillating operation to generate a clock signal, or is a usual operation state. In the specification, the terms of the stop mode and the fast mode are used in the above meaning.

When the microcomputer 7 in the standby mode is set to the stop mode, a current of several $\mu$A is consumed. On the other hand, there arises a problem in that, when a remote control signal is input, the header portion of the remote control signal cannot be read. This problem will be described with reference to FIGS. 5A to 5C. FIG. 5B shows the operation mode of the microcomputer 7, and FIG. 5C shows the current consumed by the microcomputer 7. In the case where the power source key of the remote controller 13 is pressed in the standby mode and the remote control signal of FIG. 5A is received by the signal receiving section 5, in order to enable the microcomputer 7 to decode the code C, the operation mode must be switched from the stop mode to the fast mode. This switching is performed in response to input of a signal from the signal receiving section 5 into a remote control input active line of the microcomputer 7. The output of a signal from the signal receiving section 5 to the remote control input active line of the microcomputer 7 is performed by using a falling edge of a pulse of the remote control signal as a trigger.

In theory, therefore, it is expected that the mode is immediately switched from the stop mode to the fast mode by the initial falling of the header H and the microcomputer 7 can read the header H. Actually, however, it is impossible to switch the mode from the stop mode to the fast mode simultaneously with input of the remote control signal because a certain time period (6–8 msec) is required for stabilizing the oscillating operation of the microcomputer 7. As shown in FIG. 5B, the mode is therefore switched to the fast mode with a delay of a constant time period $T_1$. At the timing when the mode is switched to the fast mode, reception of the header H of the remote control signal has been already completed to a midpoint. Even if reading of the code C is started at this timing, therefore, the header H cannot be correctly decoded. As a result, in the receiver main unit 1 which receives the remote control signal, the remote control signal becomes an error signal, and a predetermined operation based on the data signal D cannot be performed.

Consequently, it is practically impossible to set the microcomputer 7 in the standby mode to the stop mode. Even in the standby mode, therefore, the microcomputer 7 must be set to the usual fast mode. When the fast mode is set, a current of about 10–20 mA is always consumed, and hence the request for energy saving cannot be satisfied.

SUMMARY OF THE INVENTION

As described above, the related art has a problem in that, when the power saving is to be attained, the remote control cannot be operated, and, when the remote control is to be surely operated, the power saving cannot be attained. The invention has been conducted in order to solve the problem. It is an object of the invention to provide a remote controller which can satisfy both the requirements for reduction of current consumption, and ensured operation, and also an electrical apparatus which is controlled by the remote controller.

In order to attain the object, a remote controller of the invention transmits a signal in which a power-on code is added to a position preceding a code including a header and a subsequent data code portion. In an electrical apparatus on the reception side, the operation mode of a control section is switched from the stop mode to the fast mode in response to reception of the power-on code.

According to the invention, even when the operation mode of a microcomputer in the electrical apparatus under a standby mode is set to the stop mode, the mode can be transferred from the stop mode to the fast mode before the succeeding header is received. Therefore, the header can be correctly decoded, so that the current consumption can be largely reduced and the remote control operation can be surely performed.

In the invention, when the header fails to be received within a predetermined time period after reception of the power-on code, the operation mode of the microcomputer is returned from the fast mode to the stop mode, thereby suppressing the current consumption to the minimum level.

DETAILED DESCRIPTION OF THE PREFERRED EMBODIMENTS

Figure 3:
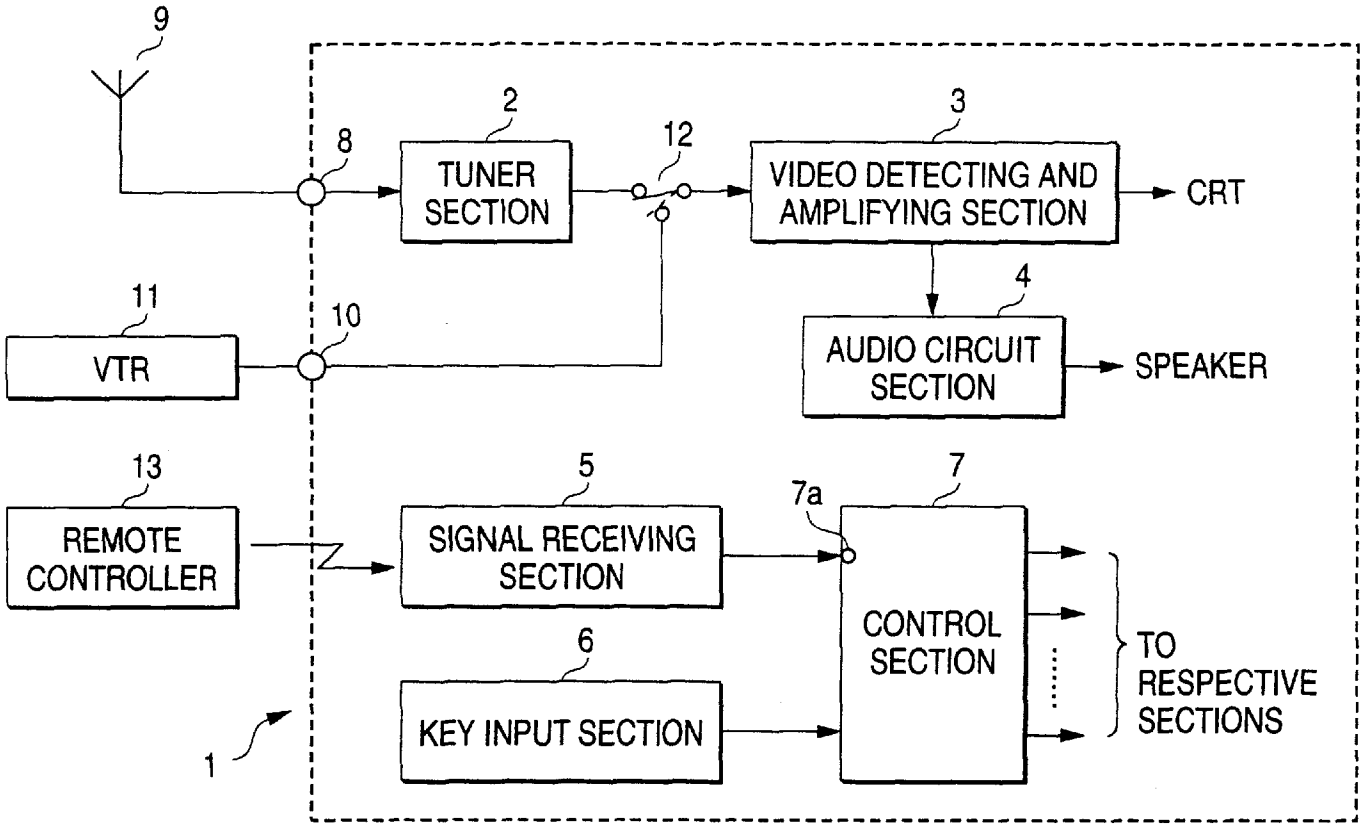
FIG. 3 is a block diagram schematically showing the configuration of a television receiver.

Hereinafter, a first embodiment of the invention will be described. The block diagram of the embodiment of the invention is strictly identical with that of FIG. 3, and hence its detailed description is omitted. The reference numerals of FIG. 3 are used also in the following description. In FIG. 1, A is a waveform chart showing the remote control signal which is transmitted from the remote controller 13. The remote control signal consists of a portion of the code C, and a portion of a code $C_o$ preceding the code portion. The code C corresponds to the data code portion in the invention, and the code $C_o$ to the power-on code portion in the invention.

Figures 5A, 5B, 5C:
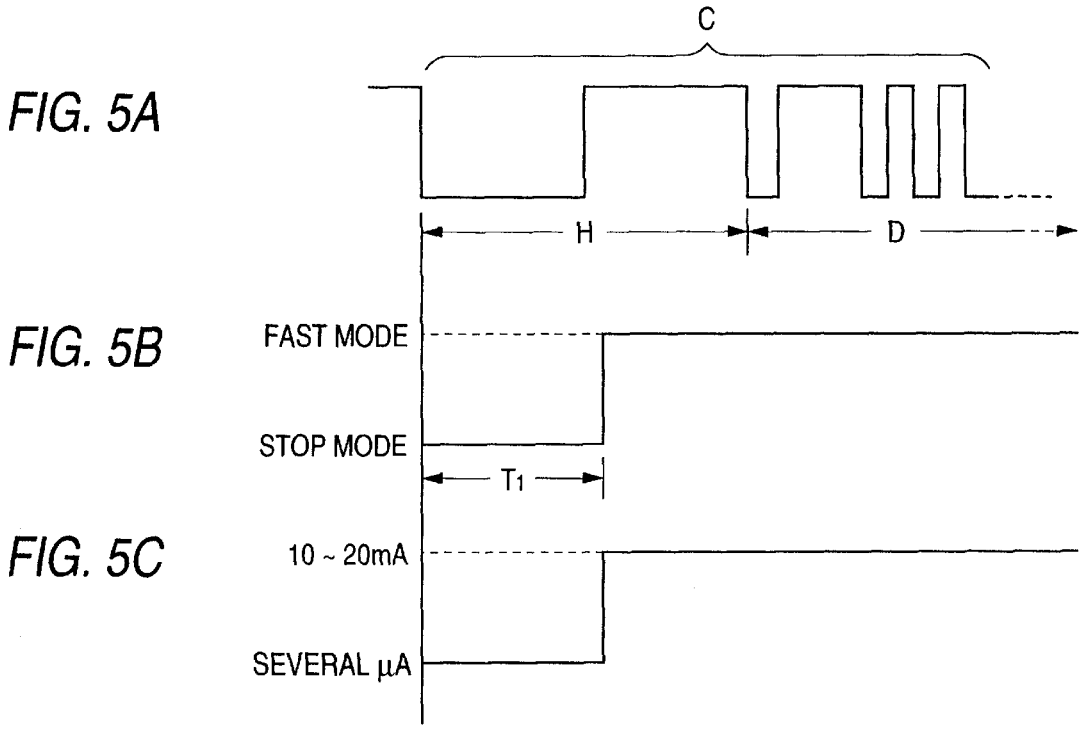
FIGS. 5A to 5C are waveform charts illustrating the operation of a related remote control system.

The code C is identical with that of the related art shown in FIG. 5, and configured by the leading header H and the subsequent data signal D. The header H is a code indicating that the signal is a remote control signal, and, in order to be clearly distinguished from noises, the pulse width is set to be long. The data signal D consists of a pulse train which corresponds to the contents of either of various controls.

Figures 1A, 1B, 1C, 1D:
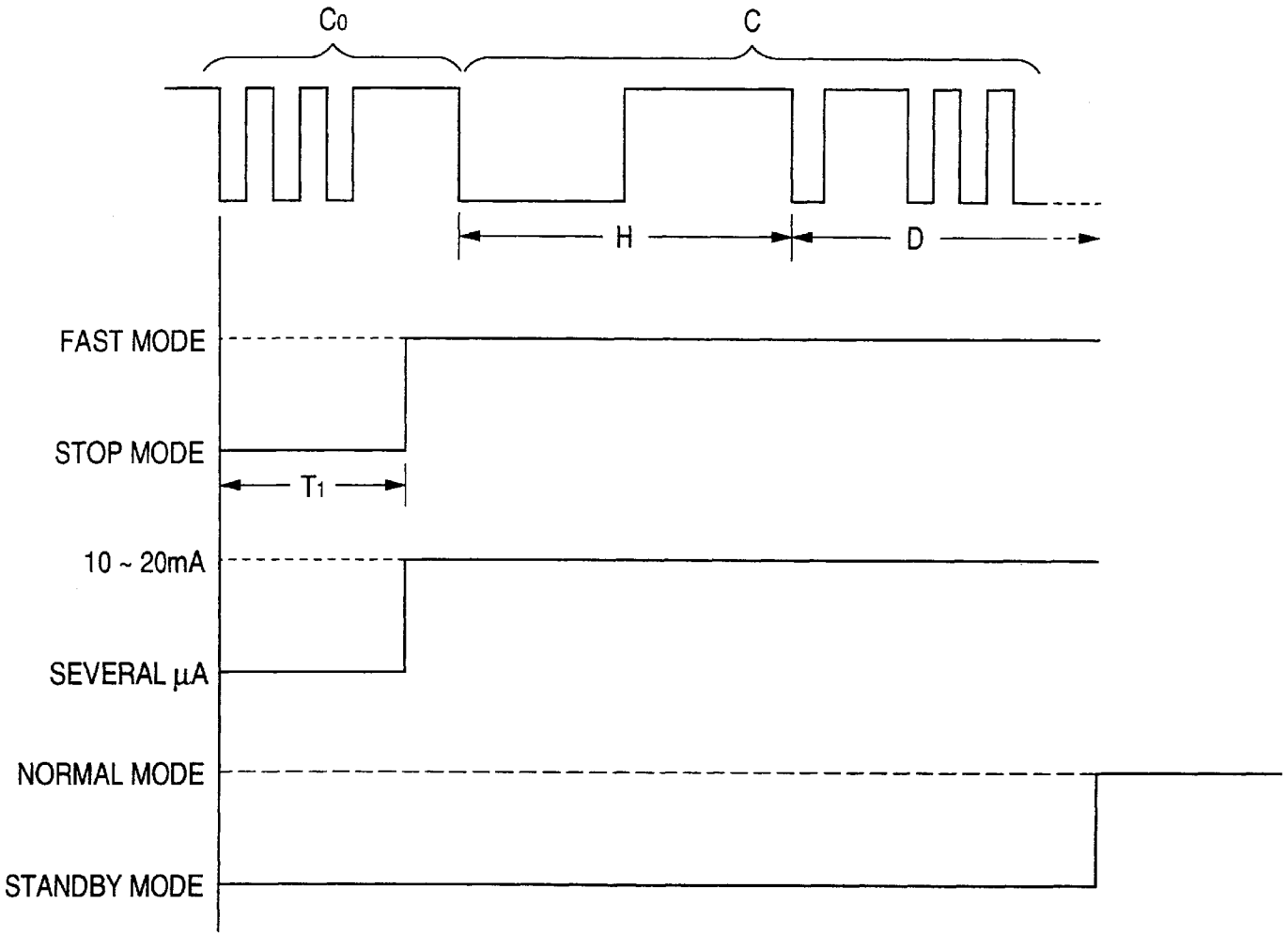
FIGS. 1A to 1D are waveform charts illustrating the operations of a remote control system according to a first embodiment of the invention.

The power-on code portion $C_o$ is a code for power on which is added to a position preceding the data code portion C, and configured by plural pulse trains. The power-on code portion is used as an interrupt signal for the microcomputer 7. The waveform of the power-on code portion $C_o$ shown in FIG. 1A is an example. A signal of another arbitrary waveform may be used as the power-on code portion.

For example, the power-on code portion may have a waveform which is substantially identical in shape with that of the header H, and in which the pulse width is long.

Next, the operation will be described. In the standby mode, the microcomputer 7 is set to the stop mode. When the power source key of the remote controller 13 is pressed in the standby mode, the remote control signal shown in FIG. 1A is transmitted from the remote controller 13. When the signal receiving section 5 receives the power-on code portion $C_o$, the power-on code portion $C_o$ is sent as an interrupt signal from the signal receiving section 5 to the microcomputer 7. In response to reception of the code $C_o$, the microcomputer 7 switches the operation mode from the stop mode to the fast mode as shown in FIG. 1B. Consequently, the current of the microcomputer 7 is increased as shown in FIG. 1C, and the microcomputer 7 transfers to the usual operation.

Specifically, in the microcomputer 7, a port 7*a* into which a signal from the signal receiving section 5 is supplied as shown in FIG. 3 is particularly selected as a port through which a signal of the highest priority is acquired. When the initial falling signal of the power-on code portion $C_o$ enters the port 7*a*, the microcomputer 7 switches its mode from the stop mode to the fast mode in which the clock signal is generated.

In this case, as described above, a certain time period must elapse before the operation of the microcomputer 7 is stabilized. Therefore, the operation mode of the microcomputer 7 is switched to the fast mode with a delay of a time period $T_1$. At the timing when the operation mode is switched to the fast mode, however, the header H of the subsequent data code portion C has not yet been received. After the operation mode is switched to the fast mode, the header H is received by the signal receiving section 5, and the microcomputer 7 decodes the header H and then judges that the received signal is a remote control signal. Thereafter, the microcomputer 7 decodes the data signal D, and then performs a predetermined control in accordance with the data signal D.

As described above, the code portion $C_o$ for power on is added to a position preceding the data code portion C, and, in response to reception of the power-on code portion $C_o$, the operation mode is switched to the fast mode before the header H is received, thereby enabling the microcomputer 7 to correctly decode the header H. Therefore, the operation mode in the standby mode can be set to the stop mode, with the result that the current consumed by the microcomputer 7 is suppressed to several $\mu$A.

When the contents of the data code portion C which is decoded as described above indicate "power on" (in the case where a remote controller is used, a button which is initially pressed is usually a "power on" button), the mode of the main unit of the electrical apparatus is switched from the standby mode to the usual mode (see FIG. 1D).

When the contents of the data code portion C do not indicate "power on", the main unit of the electrical apparatus maintains the standby mode.

Therefore, also the current consumed by the main unit of the electrical apparatus (excluding the control section 7) is saved until "power on" is correctly input.

Sometimes, a noise signal other than a remote control signal may be input to the signal receiving section 5. In the case where the waveform of such a noise signal happens to be identical with that of the power-on code portion $C_o$ shown in FIG. 1A, the operation mode of the microcomputer 7 is switched to the fast mode in accordance with the above described operations. In this case, the code C is not input after the switching to the fast mode. When the fast mode is continued as it is, therefore, the current is wastefully consumed.

Figures 2A, 2B, 2C:
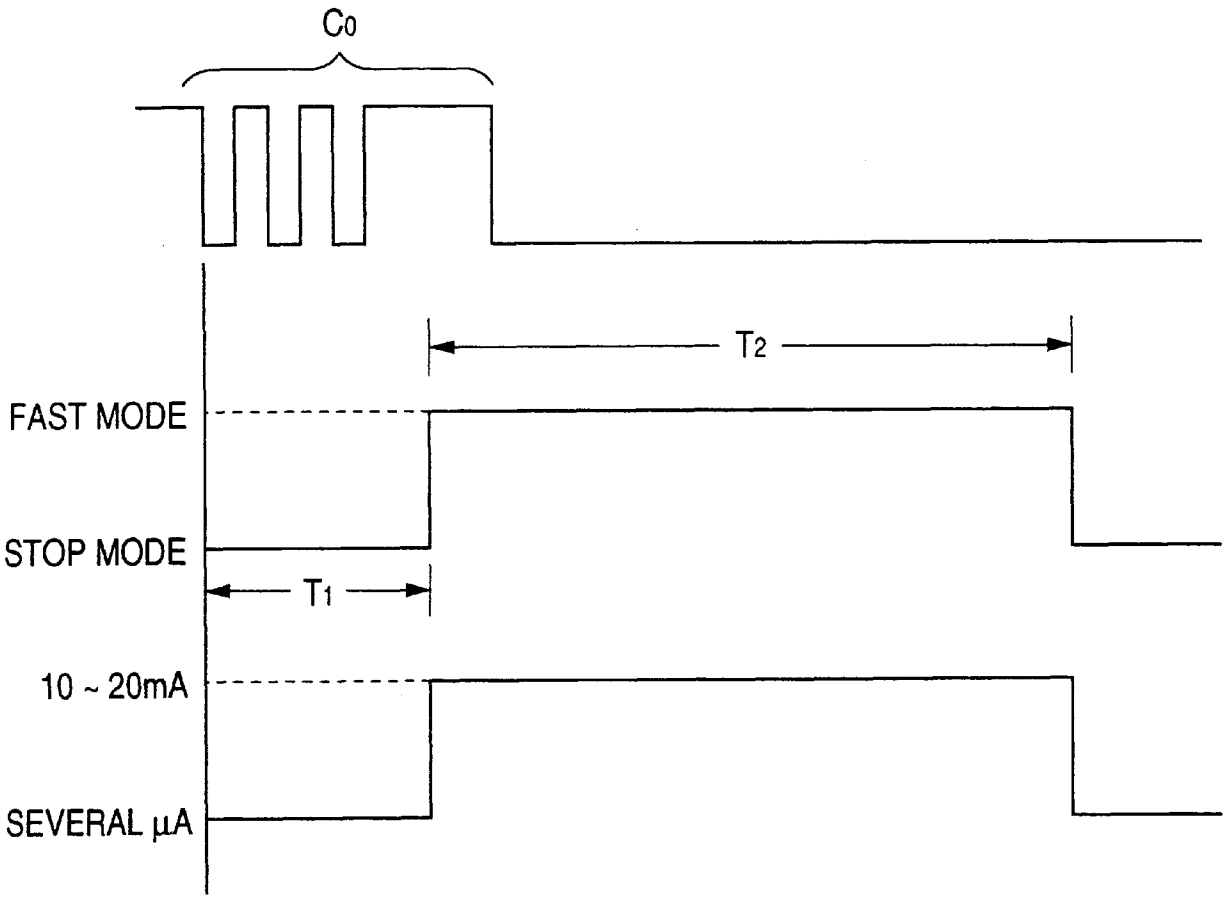
FIGS. 2A to 2C are waveform charts illustrating the operation of a remote control system-according to a second embodiment.

As a countermeasure against the above, a second embodiment may be contemplated. FIG. 2A is a waveform chart showing a remote control signal which is transmitted from the remote controller 13. FIG. 2B is a waveform chart showing the operation mode of the microcomputer 7. FIG. 2C is a waveform chart showing the current consumed by the microcomputer 7. In the charts, when the signal receiving section 5 fails to receive the header H of the data code portion C within a predetermined time period $T_2$ (for example, 10–15 msec) after the operation mode is switched to the fast mode, the operation mode of the microcomputer 7 is switched from the fast mode to the stop mode.

According to this configuration, it is possible to prevent the situation in which the operation mode is caused by a noise signal to be kept to the fast mode and the current of the microcomputer 7 is wastefully consumed, from occurring. In the above, the time period $T_2$ elapsed after switching to the fast mode is used as the reference. Alternatively, the time period elapsed after the power-on code portion $C_o$ is input may be used as the reference.

Figure 4:
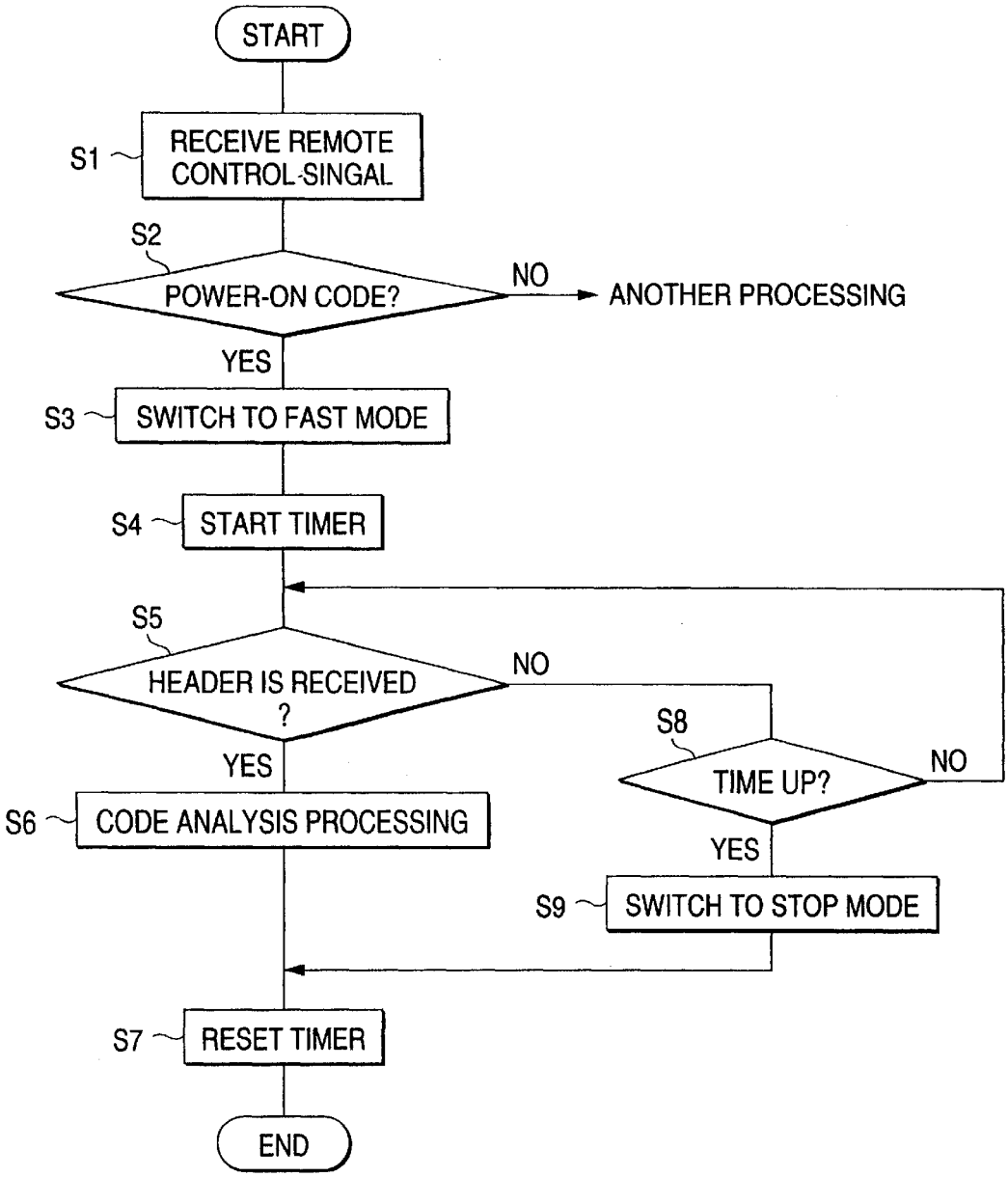
FIG. 4 is a flowchart showing the operation of a remote control system of the second embodiment.

FIG. 4 is a flowchart showing the operation of the above-described embodiment, and the procedures which are implemented by the microcomputer 7. When the remote control signal from the remote controller 13 is received by the signal receiving section 5 (S1), it is judged whether the signal is the power-on code portion $C_o$ or not (S2). If the signal is not the code (NO in S2), another process is performed. If the signal is the code (YES in S2), the operation mode of the microcomputer 7 is switched to the fast mode (S3). At the timing when the operation mode is switched to the fast mode, a timer is started (S4). Then, it is judged whether the header H of the data code portion C is received or not (S5). If the header H is received (YES in S5), the control is then transferred to a process of analyzing the code of the data signal D (S6). Thereafter, the timer is reset (S7), and the process is then ended.

If the header H is not received (NO in S5), it is judged whether the timer times up or not (S8). If the timer does time up (NO in S8), the control returns to S5 to wait reception of the header. If the timer times up (YES in S8), the operation mode is switched to the stop mode (S9), the timer is reset (S7), and the process is then ended.

In the above embodiments, a television receiver has been described as an example. However, the invention is not restricted to this, and may be applied to any kind of apparatus involving remote control operation, such as a VTR or an air conditioner. In the invention, the header H means a signal which, when read by a microcomputer, causes the microcomputer to know that the signal D immediately subsequent to the signal is a data. The header may have a waveform other that shown in the accompanying drawings.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A remote control system comprising:

an electrical apparatus; and a remote controller having a power source key for transmitting a remote control signal including a header, a data code portion subsequent to the header, and a power-on code portion preceding to the header to turn on the electrical apparatus;

wherein the electrical apparatus includes:

a receiving section for receiving the remote control signal transmitted from the remote controller; and a control section for switching the electrical apparatus from a standby mode to a normal mode in accordance with the data code portion, the control section having a stop mode and a fast mode as an operation mode thereof; and wherein the control section switches the operation mode thereof from the stop mode to the fast mode when the receiving section receives the power-on code portion.

2. The remote control system as set forth in claim 1, wherein the control section switches the operation mode thereof from the fast mode to the stop mode when a predetermined time period has elapsed without receiving the header since the power-on code portion was received.

3. The remote control system as set forth in claim 1, wherein the control section is configured by a microcomputer.

4. The remote control as set forth in claim 3, wherein the microcomputer includes an input port having a highest priority, a signal from the receiving section being input to said input port having the highest priority.

5. The remote control system as set forth in claim 1, wherein the electrical apparatus has a standby mode as an operation mode thereof, in which a predetermined operation is immediately executed upon receipt of the remote control signal instructing a power-on operation; and wherein the control section switches the operation mode thereof from the stop mode to the fast mode when the receiving section of the electrical apparatus under the standby mode receives the power-on code portion.

6. The remote control system as set forth in claim 1, wherein the power-on code portion includes a plurality of pulse trains.

* * * * *